United States Patent [19]

Crisp et al.

[11] Patent Number: 4,752,152

[45] Date of Patent: Jun. 21, 1988

[54] VEHICLE SECURITY BARRIER

[76] Inventors: William T. Crisp, Second Norway La., Oliver Springs, Tenn. 37840; Jack D. Elkins, Rte. 2, Box 272, Pickle Farm Rd., Kingston, Tenn. 37763

[21] Appl. No.: 27,743

[22] Filed: Mar. 19, 1987

[51] Int. Cl.[4] ..... E01F 13/00

[52] U.S. Cl. ..... 404/6; 49/33; 49/49; 49/131

[58] Field of Search ..... 404/6, 9–11; 49/9, 33, 49, 131–134

[56] References Cited

U.S. PATENT DOCUMENTS

| | | | |
|---|---|---|---|
| 1,709,344 | 4/1929 | Gage et al. | 49/9 |
| 1,765,906 | 6/1930 | Coder | 49/133 |
| 2,735,202 | 2/1956 | King | 49/33 X |
| 3,783,558 | 1/1974 | Keator | 49/33 X |
| 4,152,871 | 5/1979 | Kardash, Jr. | 49/49 |
| 4,354,771 | 10/1982 | Dickinson | 404/6 |
| 4,490,068 | 12/1984 | Dickinson | 404/6 |
| 4,572,080 | 2/1986 | Williams et al. | 404/6 X |
| 4,574,523 | 3/1986 | Nasatka | 49/49 |
| 4,627,763 | 12/1986 | Roemer et al. | 404/6 |
| 4,630,395 | 12/1986 | Nasatka | 49/49 |

*Primary Examiner*—Stephen J. Novosad
*Assistant Examiner*—John F. Letchford
*Attorney, Agent, or Firm*—Pitts and Brittian

[57] ABSTRACT

A vehicle security barrier (10) for selectively prohibiting a vehicle from accessing a preselected area and for otherwise controlling vehicular traffic. The security barrier (10) comprises a base (12) defining a travelway (14) over which a vehicle can be driven. The base (12) comprises a forward end portion defining an entryway (20) whereby a vehicle enters onto the travelway (14) and a rearward end portion defining a travelway exit (22) whereby a vehicle exits the travelway (14). The security barrier (10) further comprises a security gate (18) pivotally mounted on the base (12) for being selectively raised to obstruct the travelway (14) and prohibit a vehicle for exiting the travelway via the travelway exit (22). Reciprocal actuating means are also provided for selectively raising and lowering the gate (18). In the preferred embodiment, the reciprocal actuating means comprises a first and second fluid actuated cylinder (64A and B).

19 Claims, 7 Drawing Sheets

VEHICLE SECURITY BARRIER

TECHNICAL FIELD

This invention relates to a vehicle security barrier for selectively controlling vehicular traffic on a roadway. The security barrier generally comprises a base portion defining a travelway and a security gate mounted on the base portion which can be selectively raised to prohibit vehicular travel through the security barrier.

BACKGROUND ART

In order to isolate or secure a specified area, it is common to place barriers across the roadways leading into the area such that vehicular access can be controlled. Roadway barriers are also used where vehicles and their occupants must simply be stopped and checked for some reason. Examples of certain prior art barriers are disclosed in U.S. Pat. No. 1,765,906, issued to H. S. Coder on June 24, 1930; and U.S. Pat. No. 1,709,344, issued to C. H. Gage, et al., on Apr. 16, 1929. However, heretofore difficulty has been encountered in devising barriers which are capable of withstanding the impact of a speeding vehicle such that access to the restricted area or roadway is denied. This has been a particular problem where temporary barriers must be established. Further, once a vehicle has been stopped at a roadway barrier, it is important in many circumstances that the operators of the barrier have as much control as possible over the vehicle and its occupants. Ideally, once the vehicle is stopped at the barrier, it should be prohibited from turning to either side to avoid the barrier and prohibited from backing away from the barrier.

Therefore, it is an object of the present invention to provide a vehicle security barrier for selectively controlling vehicular traffic on a roadway.

It is a further object of the present invention to provide a vehicle security barrier which is capable of withstanding the impact of a moving vehicle and still prohibit access to the roadway beyond the barrier.

Yet another object of the present invention is to provide a vehicle security barrier which may be easily transported, either in an assembled or disassembled state, to a roadway to effect a temporary security barrier.

Still another object of the present invention is to provide a vehicle security barrier which allows maximum control over a vehicle and its occupants when such vehicle is stopped at the security barrier.

A further object of the present invention is to provide a vehicle security barrier which is inexpensive to manufacture and maintain.

DISCLOSURE OF THE INVENTION

Other objects and advantages will be accomplished by the present invention which provides a vehicle security barrier for selectively prohibiting a vehicle from accessing a preselected area and for otherwise controlling vehicular traffic. The vehicle security barrier comprises a base defining a travelway over which a vehicle can be driven. The base comprises a forward end portion defining an entryway whereby a vehicle enters onto the travelway and a rearward end portion defining a travelway exit whereby a vehicle selectively exits the travelway. The security barrier further comprises a security gate which is pivotally mounted on the base for being selectively raised to obstruct the travelway and prohibit a vehicle from exiting the travelway. Reciprocal actuating means are also provided for selectively raising and lowering the security gate. Thus, the security barrier can be positioned on an existing roadway to intercept vehicular traffic and either prohibit or allow the vehicles access to the roadway beyond the barrier.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
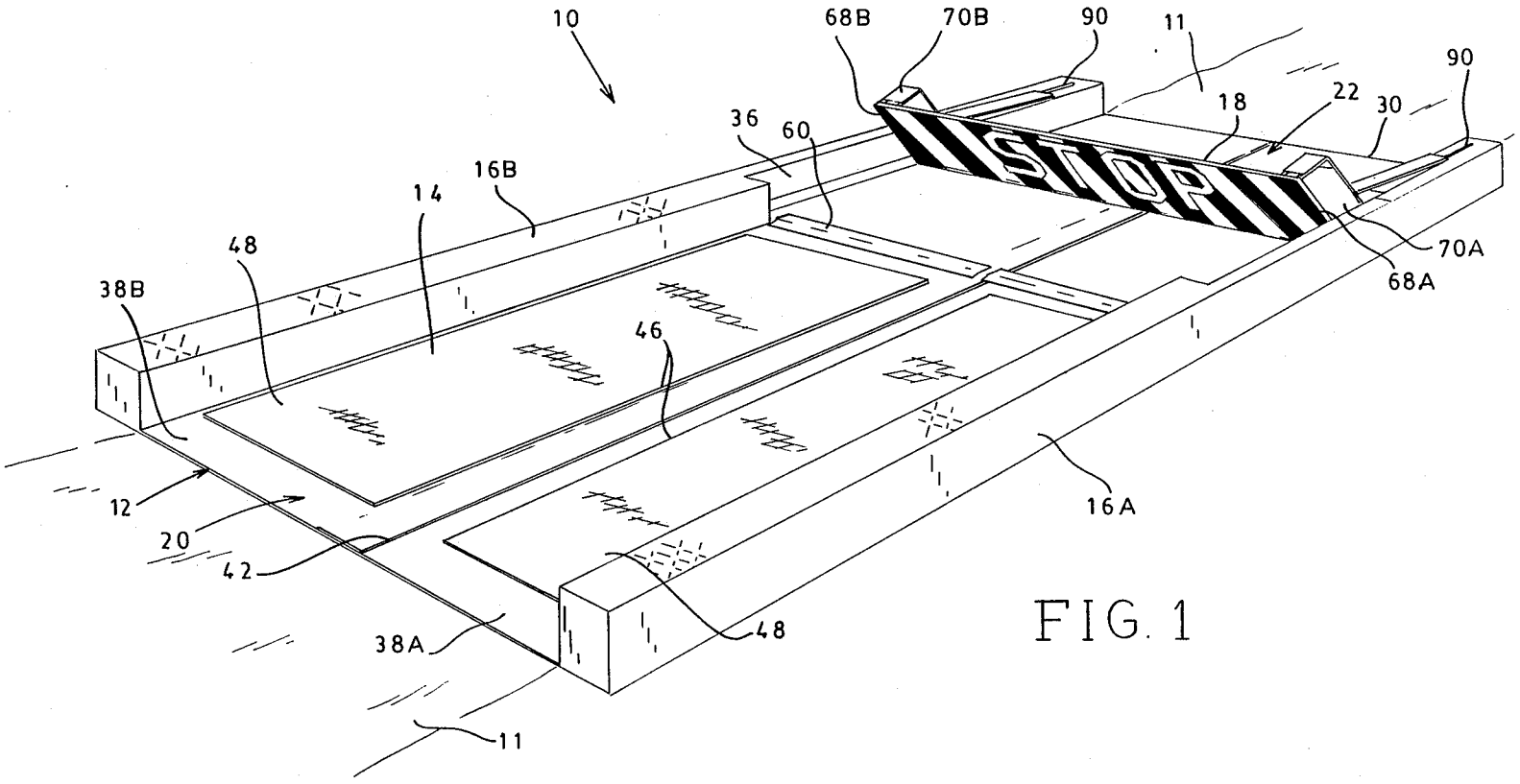
FIG. 1 illustrates a perspective view of a vehicle security barrier of the present invention wherein security gate is in a normally raised position.
Figure 2:
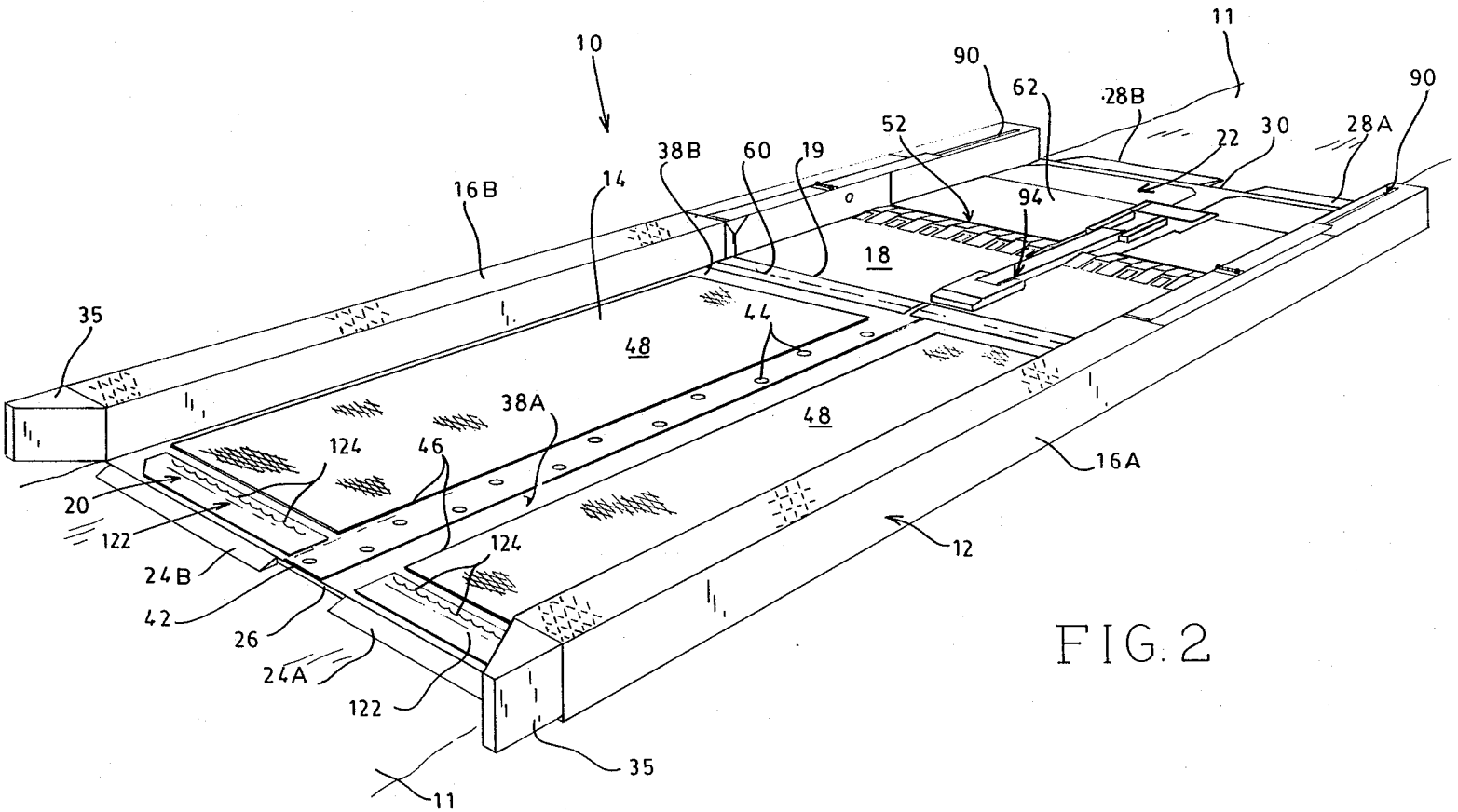
FIG. 2 illustrates a perspective view of a vehicle security barrier of the present invention wherein the security gate is in a lowered position.

A vehicle security barrier incorporating various features of the present invention is illustrated at 10 in the figures. As will be apparent from the discussion which follows, the security barrier 10 is designed to be easily transported, in either an assembled or disassembled state, to a roadway 11 to provide a means for controlling vehicular travel on the roadway and/or for limiting access to a selected area via such roadway. The security barrier 10 generally comprises a base portion 12 defining a travelway 14 bounded on either side by longitudinal side barriers 16A and 16B. A security gate 18 is pivotally mounted on the base portion 12 for selectively closing the travelway 14 to vehicular travel. Accordingly, it will be undertood that the barrier 10 is utilized by placing it on the roadway 11 where vehicular travel is to be controlled such that the travelway 14 intercepts the vehicular traffic on the roadway. The gate 18 is then selectively raised to restrict a vehicle's travel from the travelway 14 back onto the roadway.

Figure 4:
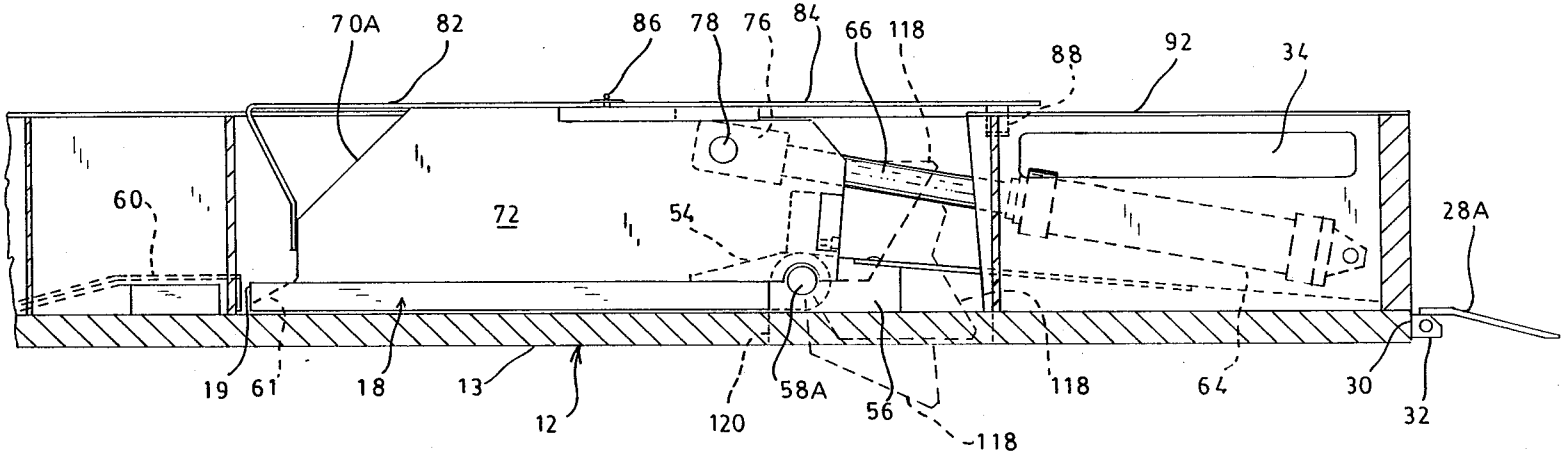
FIG. 4 is a partial side elevation, partially in section at A—A of FIG. 3, of a vehicle barrier of the present invention.

More specifically, the base portion 12 defines a forwardly disposed entryway 20 whereby a vehicle accesses the travelway 14, and a rearwardly disposed exit 22 whereby a vehicle exits the travelway 14. Moreover, in the preferred embodiment, entry onto the travelway 14 is facilitated by the entry ramp members 24A and B which are mounted on the forward edge 26 of the base 12, and exit from the travelway 14 is facilitated by the exit ramp members 28A and 28B which are attached to the rearward edge 30 of the base 12. Whereas, the entry ramp members 24A and B and the exit ramp members 28A and B can be integral with, or fixedly attached to, the base 12, in the preferred embodiment, the ramp members 24 and 28 are pivotally and releasably attached to the base 12 with hinge members 32 (as illustrated in FIG. 4 with respect to the ramp members 28A) such that they more readily engage the surface of the roadway and such that they can be removed during transport.

Also, as indicated above, the base 12 comprises longitudinal side barriers 16A and 16B. The side barriers 16A and B serve primarily to prohibit a vehicle which has entered onto the travelway 14 from exiting other than via the exit 22 or by backing out of the entryway 20. However, proximate the rearward end portion of the security barrier 10, the side barriers 16A and B each define a cylinder housing 34 and a gate housing 36 both of which will be discussed further hereinafter. It will also be noted that the side barriers 16A and B can be provided with detachable curb guides 35, if desired, to facilitate a vehicle's entry onto the travelway 14.

Figure 3:
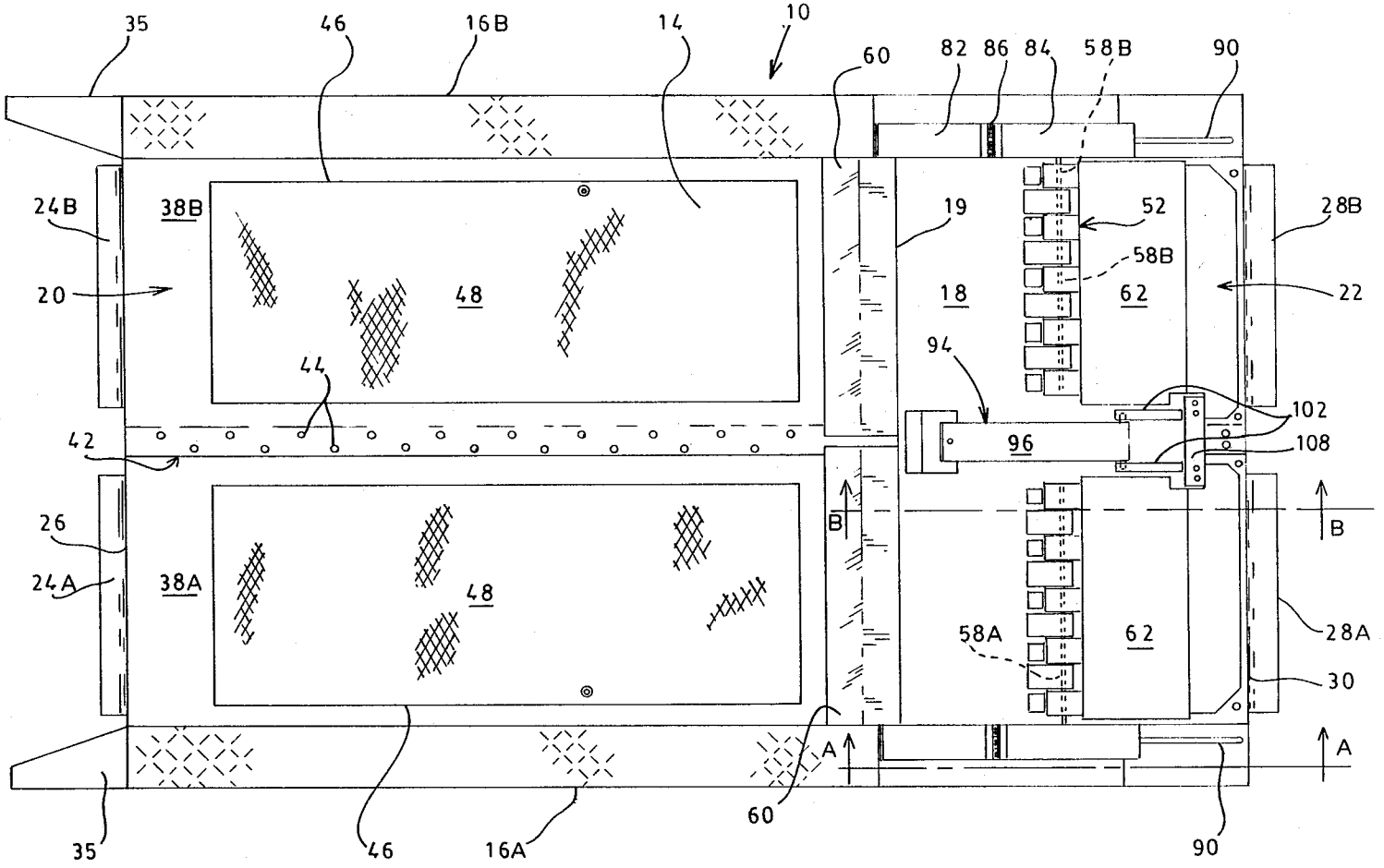
FIG. 3 illustrates a top view of a vehicle security barrier of the present invention.
Figure 7:
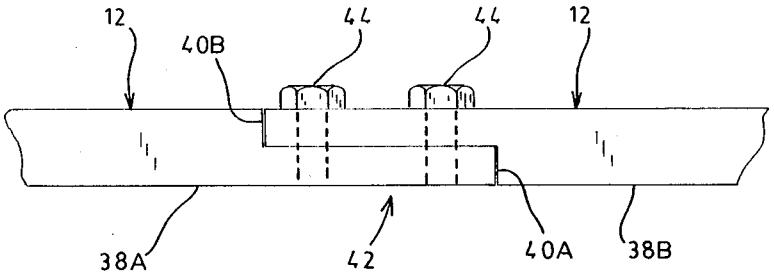
FIG. 7 illustrates an end view of the base of a vehicle security barrier of the present invention.

As is best illustrated in FIGS. 3 and 7, in the preferred embodiment the base 12 comprises first and second oppositely disposed sections 38A and 38B, respectively, preferably fabricated of a strong durable metal. The sections 38A and B define inner edge portions 40A and B, respectively, which are releasably joined by suitable fastening means. In this regard, the inner edge portions 40A and 40B form an overlapping longitudinal joint 42 releasably secured with a plurality of bolts 44. Of course, it will be understood that the base portion 12 can be fabricated as an intregral unit. However, the ability to break the base portion 12 down into the sections 38A and 38B facilitates transport of the base portion 12. It will also be noted that in the preferred embodiment each of the sections 38A and B define an opening 46 which is releasably receptive of a travelway panel 48 preferably fabricated of expanded metal. Thus, the panels 48 can be removed such that the individual sections 38A and B are more easily transported.

The security gate 18 is pivotally mounted on the base 12 proximate the rearward portion of the base 12 and is disposed such that when raised, the gate 18 blocks the travelway 14 and prohibits a vehicle from exiting the security barrier 10 through the exit 22. Preferably the gate 18 is fabricated of a strong durable metal. Of course, the positioning of the gate 18 proximate of the rearward portion of the base 12 allows a vehicle to be driven onto the travelway 14, such that all or substantially all of the vehicle is positioned on the security barrier. It will be appreciated by those skilled in the art that when the vehicle is committed to a position on the security barrier 10 between the side barriers 16A and B, the operators of the security barrier 10 are in a better position to exercise control over the vehicle and its occupants.

As illustrated, the security gate 18 is pivotally secured to the base 12 with a hinge 52 such that the gate 18 pivots forward to lay flat against the travelway 14 to selectively allow vehicles to pass through the security barrier 10. In the preferred embodiment, the hinge 52 comprises a plurality of gate mounting segments 54 secured to the gate 18 and a plurality of base segments 56 secured to the base 12, the segments 54 and 56 being designed to interlock and pivotally receive the mounting shafts 58A and B. Of course, it will be understood that other suitable hinge means can be utilized if desired and the illustrated hinge 52 is simply illustrative of a suitable hinge means. Further, it will be noted that when the gate 18 is lowered to allow a vehicle to exit the security barrier 10, the vehicle must travel over the gate 18. In order to facilitate a vehicle's smooth, unobstructed travel over the gate 18, a pair of forward gate ramps 60 and a pair of rearward gate ramps 62 are provided in the preferred embodiment. It will be noted, however, that the forward gate ramps 60 can be obviated by bevelling the outboard edge 19 of the gate 18 as illustrated by the broken line at 61 of FIG. 4.

In order to raise and lower the security gate 18, the security barrier 10 is provided with reciprocal actuating means. In the preferred illustrated embodiment such actuating means comprises a pair of pneumatic cylinders 64A and B provided with selectively reciprocating actuator arms 66, the cylinders 64 being powered by a suitable compressed gas source (not shown) and provided with suitable control means (not shown). However, it will be understood that other reciprocal actuator means can be utilized if desired; as for example, hydraulic cylinders or electromagnetic actuators. This notwithstanding, the cylinders 64A and B are housed within the cylinder housings 34A and B, respectively, and are pivotally secured at their rearward end portions to the base 12. In order to facilitate the securing of the actuator arms 66A and B to the gate 18 such that the cylinders serve to raise and lower the gate 18, the opposite end portions 68A and B of the gate 18 extend into the gate housings 36A and B, respectively, and are provided with actuator arm engaging assemblies 70A and 70B. Resultantly, when the actuator arms 66A and B are substantially fully extended, the gate 18 is in a lowered position, and retraction of the actuator arms 66A and B into the cylinders 64A and B, respectively, raises the gate 18 to prohibit vehicles from exiting the barrier 10 via the exit 22.

In the preferred embodiment of the security barrier 10, the actuator arm engaging assemblies 70A and B comprise a pair of mounting plates 72 and 74 secured to, and disposed substantially perpendicular to, the gate 18 proximate the opposite end portions 68A and B of the gate 18 so as to be selectively received in the gate housing 36A and B. The outboard end portion 76 of the actuator arm 66 is received between and pivotally secured to the mounting plates 72 and 74 at a pivot point 78. It will be noted that the pivot point 78 is located such that as the gate 18 is pivoted from the travelway 14 to a raised position, the pivot point 78 is at all times above the level of the pivot point of the hinge 52 such that sufficient leverage is provided for the cylinders 64 to raise the gate 18. It will also be noted that the assemblies 70A and B are each provided with a gate housing cover 80 secured to the mounting plates 72 and 74, the covers 80 serving to cover the upper portion of the gate housing 36 when the gate 18 is in a lowered position. Each of the covers 80 comprises a first and second cover panel 82 and 84, respectively, pivotally joined by hinge 86. The outboard end portion of the second panel 84 carries a follower 88 which is slidably received in a longitudinally disposed elongated opening 90 in each cylinder housing cover 92. Accordingly, it will be understood by those skilled in the art that when the gate 18 is raised, the cover panel 82 pivots with respect of the panel 84 and the panel 84 slides rearwardly (the follower 88 sliding rearwardly in the opening 90) thereby accommodating the upward pivoting of the gate 18.

Figure 6:
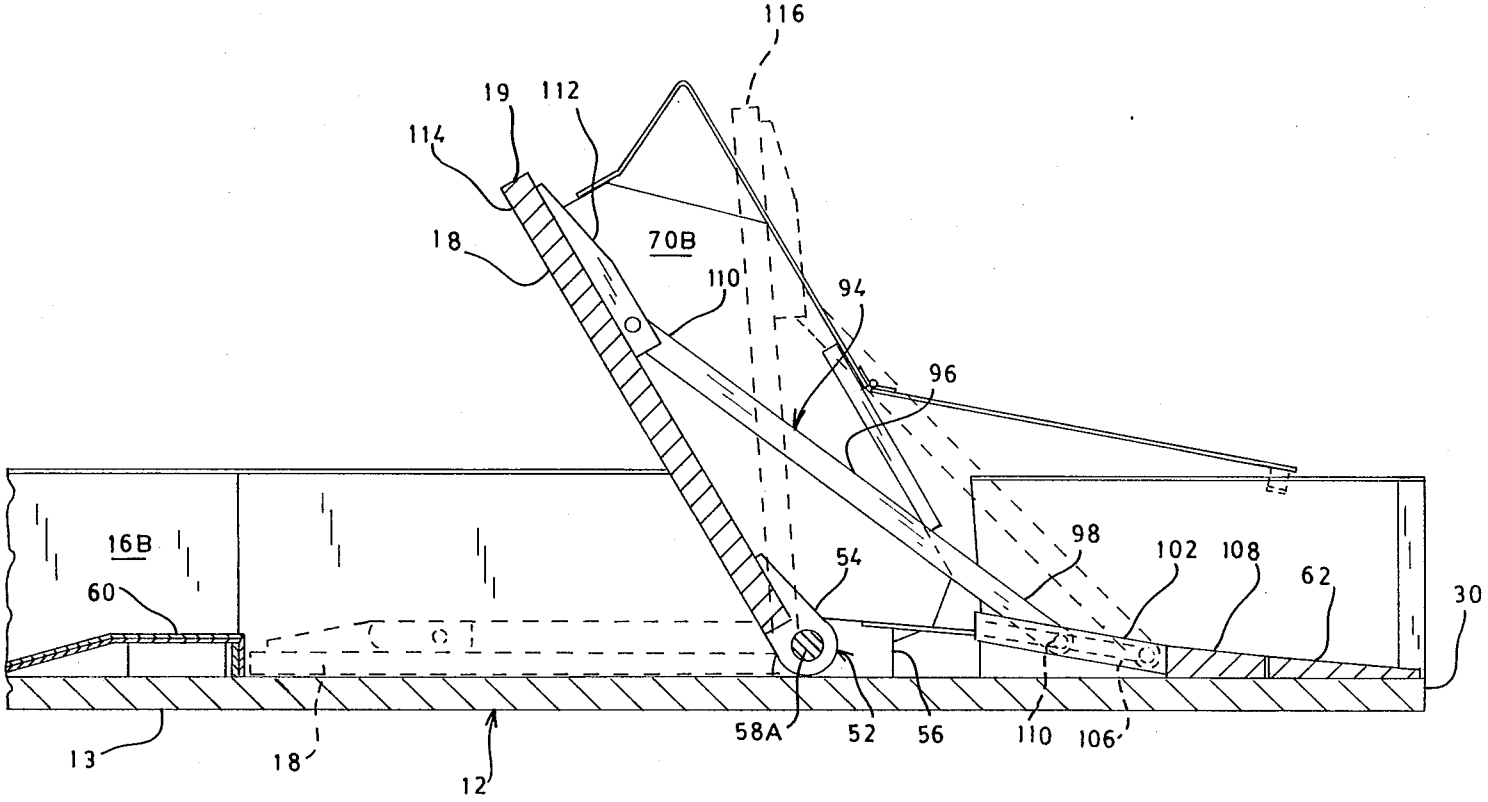
FIG. 6 illutrates a partial side elevation view, in section at B—B of FIG. 3, of a vehicle security barrier of the present invention.
Figure 9:
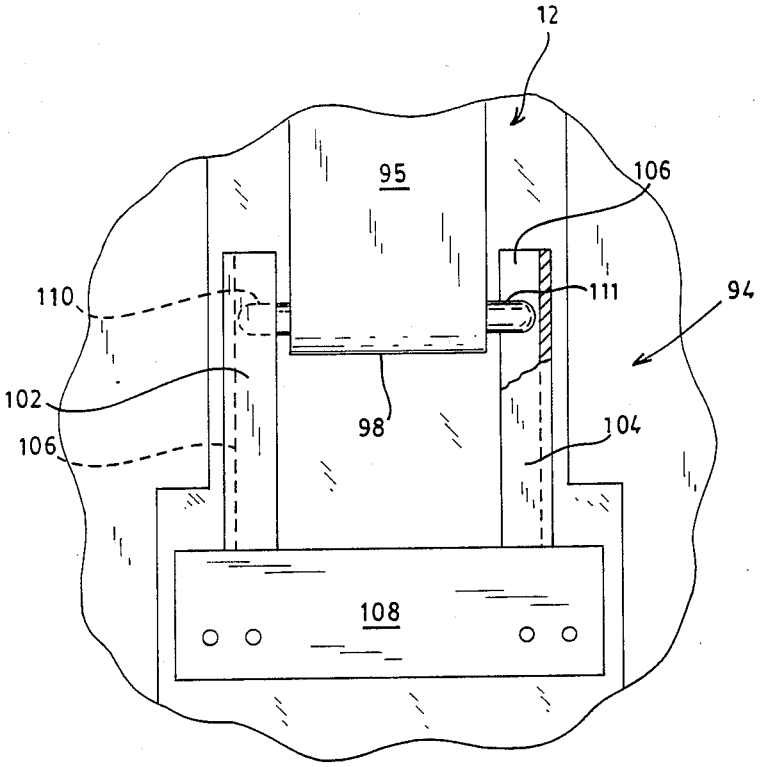
FIG. 9 is a top view of a portion of the gate support means of a vehicle security barrier of the present invention.

Referring now to FIGS. 6 and 9, in order to further support the gate 18 when in a raised position such that the gate 18 can sustain a substantial impact from a moving vehicle and still prohibit such vehicle from traversing the security barrier 10, the barrier 10 is provided with a gate support means 94. In the preferred illustrated embodiment, the gate support means 94 comprises a support arm 96 having a first end portion 98 pivotally and slidably secured to the base 12, and a second end portion 100 pivotally secured to the gate 18 proximate the outboard edge 19 of the gate 18. More specifically, a pair of oppositely disposed support guide members 102 and 104 are provided on the base 12, each of the guide members 102 and 104 defining a groove 106, with a stop member 108 also being provided on the base 12 rearward of the guide members 102 and 104. The first end portion 98 of the support arm 96 is provided with oppositely disposed mounting stems 110 and 111 which are slidably and pivotally received in the grooves 106 of the guide members 102 and 104 thereby securing the support arm 96 to the base 12. The second end portion 100 of the support arm 96 is, in turn, pivotally secured to a gate support mount 112 carried by the gate 18.

In light of the above, it will be understood that when the gate 18 is in a lowered position, the first end portion 98 of the support arm 96 is positioned proximate the forward end of the guide members 102 and 104. As the gate 18 is raised the first end portion 98 slides rearwardly and pivots as the second end portion 100 follows the rising motion of the gate. Of course, when the gate 18 rises to the point where the first end portion 98 engages the stop member 108 the support arm 96 braces against the stop member 108 prohibiting further pivoting of the gate 18. In this regard, however, it is contemplated that in normal use, the gate 18 will be raised only to the normally raised position indicated at 114 in FIG. 6 such that the gate support means 94 is not engaged. In the preferred embodiment, it is only upon a vehicle impacting the gate 18 with substantial force that it is contemplated that the gate will pivot to the full impact position indicated at 116 such that the gate support means 94 will be engaged. Thus, upon inadvertant, insubstantial contact with the gate 18, the gate 18 will pivotally giveway to the point of the full impact position 116 such that damage to the security barrier 10 and the vehicle is avoided or minimized. Moreover, even when the impact is sufficient to engage the gate support means 94, it will be appreciated that some of the force of the impact is absorbed by the cylinders 64 and in the movement of the gate as the gate 18 pivots from the normally raised position 114 to the full impact position 116.

Figure 8:
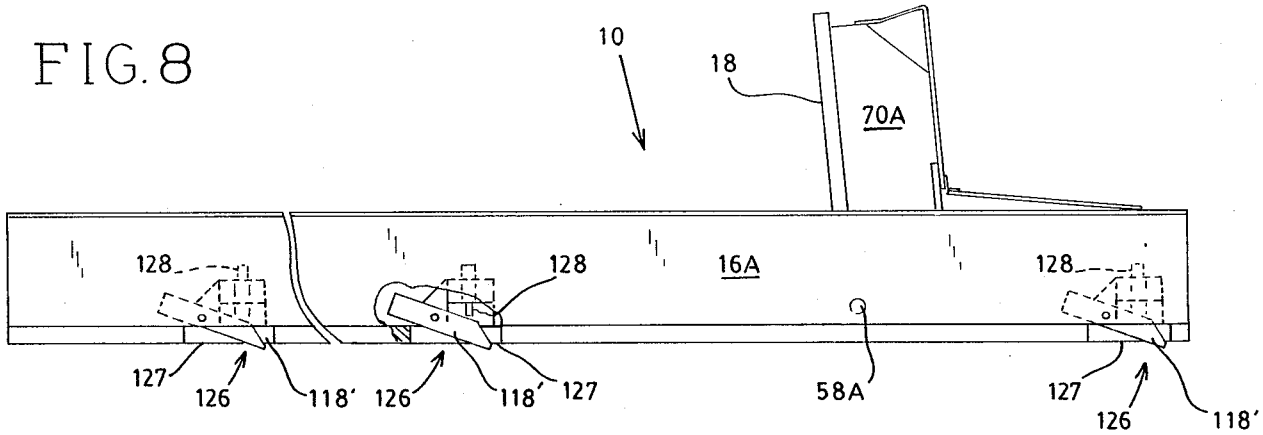
FIG. 8 illustrates a side elevation view of a security barrier of the present invention.
Figure 5:
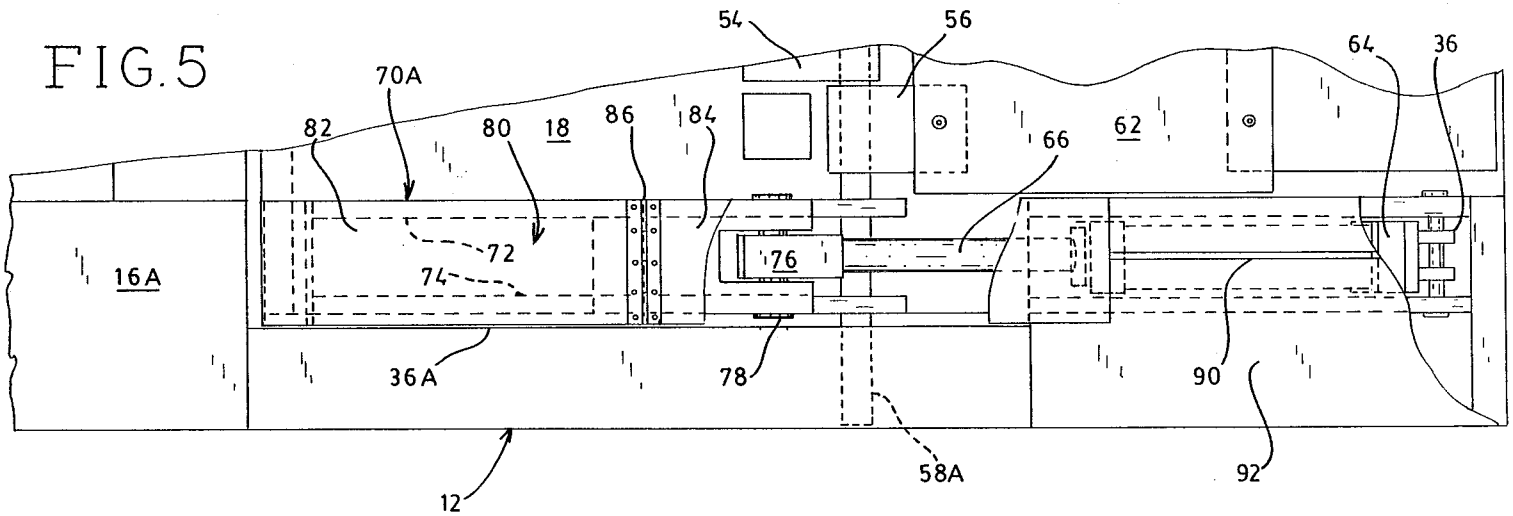
FIG. 5 illustrates a top view of the reciprocal actuating means of a vehicle security barrier of the present invention.

It will be appreciated that if a vehicle impacts the gate 18 at sufficient velocity, the vehicles momentum will cause the security barrier 10 to slide or skid on the roadway underlying the security barrier 10. In order to obviate or minimize possible skidding, the preferred embodiment of the barrier 10 is provided with anti-skid means. Whereas such means can comprise cleats or other friction producing devices provided on the lower surface 13 of the base 12, in one preferred embodiment (see FIG. 4) such anti-skid means comprises a pair of foot members 118 mounted on the actuator arm engaging assemblies 70A and B of the gate 18 (or directly on the lower edge of the gate 18 if desired) such that the foot members 118 pivot with the gate 18. As illustrated by broken lines, openings 120 are provided in the base 12 to accommodate the pivoting of the foot members 118, and it will be noted that when the gate 18 is raised to the normally raised position 114 the foot members 118 are received in the openings 120, but do not pivot sufficiently to extend below the lower surface 13 of the base 12. However, as the gate 18 is pivoted beyond the normally raised position 114 toward the full impact position, as when a vehicle impacts the gate 18, the foot members 118 pivot below the surface 13 and engage and grip the roadway beneath to prohibit or minimize the skidding of the security barrier 10 on the roadway. Alternatively, as illustrated in FIG. 8, the anti-skid members 126 can be mounted on the base 12 at selected locations. The anti-skid members 126 each comprise a foot member 118′ which is pivotally mounted on the base 12 proximate an operatively associated opening 127 and downwardly biased with spring biasing means 128. Thus, as illustrated, the foot member 118′ pivots through the opening 127 and engages the roadway beneath the barrier 10.

As indicated above, when a vehicle enters the security barrier 10, the security gate 18 prohibits the vehicle from exiting through the exit 22 and the side barriers 16A and B prohibit the vehicle from turning to the side and driving around the gate 18. Additionally, it is contemplated that the barrier 10 can be provided with anti-back up means to prevent a vehicle from backing out of the entryway 20. Whereas various anti-backup means can be utilized, in one preferred embodiment such means comprises one or more tire puncture devices 122 pivotally mounted on the base 12 proximate the forward edge 26. As illustrated, the puncture devices 122 carry a plurality of teeth 124 which can be pivoted toward the rearward portion of the base 12 such that a vehicle entering the barrier 10 can drive over the puncture devices 122, but when attempting to back over the devices 122 the teeth 124 can be pivoted upwardly such that the tires of the vehicle will be punctured by the teeth 124.

In light of the above, it will be appreciated that the present invention provides a vehicle security barrier which can be easily transported to selected locations and placed over a roadway to intercept and control vehicular travel. The security barrier 10 is capable of withstanding the impact of a moving vehicle and still prohibit access to the roadway beyond, and offers maximum control over a vehicle and its occupants when the vehicle is stopped on the barrier 10. Therefore, the barrier 10 is ideal for temporary, or permanent road blocks, or for temporarily or permanently controlling vehicular access to a secured area. It will also be understood that the security barrier 10 can be utilized as a gangway for stairs or as a bridge to provide controlled vehicular travel over a ditch, gully or small stream.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A vehicle security barrier for selectively prohibiting a vehicle from accessing a preselected area and for otherwise controlling vehicular traffic, said vehicle security barrier comprising:

a base defining a travelway over which said vehicle can be driven, said base comprising a forward end portion defining an entryway whereby said vehicle enters onto said travelway and a rearward end portion defining a travelway exit whereby said vehicle selectively exits said travelway;

a security gate pivotally mounted on said base for being selectively raised to obstruct said travelway and prohibit said vehicle from exiting said travelway via said travelway exit, said security gate having an outboard edge;

gate support means for bracing said gate upon said gate pivoting to a preselected vehicle impact position, said gate support means having at least one support arm having a first end portion pivotally and slidably secured to said base and a second end portion pivotally secured to said gate proximate said outboard edge of said gate, said gate support member further having at least one stop member secured on said base for terminating the sliding movement of said first end portion of said support arm when said gate is in said preselected vehicle impact position; and reciprocal actuating means for selectively raising and lowering said security gate.

2. The vehicle security barrier of claim 1 wherein said base comprises first and second side barriers oppositely disposed on either side of said travelway for preventing said vehicle from exiting said travelway.

3. The vehicle security barrier of claim 1 wherein said reciprocal actuating means comprises at least one fluid actuated cylinder mounted on said base, said cylinder comprising a selectively reciprocating actuator arm for engaging and pivoting said gate.

4. The vehicle security barrier of claim 3 wherein said security gate defines a first end portion and a second end portion, and said reciprocal actuating means comprises a first said fluid actuated cylinder for engaging said first end portion of said gate, and a second said fluid actuated cylinder for engaging said second end portion of said gate.

5. The vehicle security barrier of claim 4 wherein said base comprises first and second side barriers oppositely disposed on either side of said travelway for preventing said vehicle from exiting said travelway, said first and second side barriers defining first and second cylinder housings, respectively, for housing said first and second fluid actuated cylinders.

6. The vehicle security barrier of claim 5 wherein said first and second side barriers define first and second gate housings, respectively, for receiving said first and second end portions of said gate.

7. The vehicle security barrier of claim 1 wherein said gate is pivotally mounted on said base proximate said rearward end portion of said base whereby at least a substantial portion of said vehicle can be received on said travelway, forward of said gate, as said gate is pivotally raised.

8. A vehicle security barrier for selectively prohibiting a vehicle from accessing a preselected area and for otherwise controlling vehicular traffic on a roadway, said vehicle security barrier comprising:

a base defining a travelway over which said vehicle can be driven, said base comprising first and second side barriers oppositely disposed on either side of said travelway for preventing said vehicle from exiting said travelway, said base further comprising a forward end portion defining an entryway whereby said vehicle enters onto said travelway and a rearward end portion defining a travelway exit whereby said vehicle selectively exits said travelway;

a security gate pivotally mounted on said base proximate said rearward end portion of said base for being selectively raised to obstruct said travelway and prohibit said vehicle from exiting said travelway via said exit, said gate defining an outboard edge;

reciprocal actuating means for selectively raising and lowering said security gate; and gate support means for bracing said gate upon said gate pivoting to a preselected vehicle impact position, said gate support means comprising a support arm having a first end portion pivotally and slidably secured to said base and a second end portion pivotally secured to said gate proximate said outboard edge of said gate, said gate support member further comprising a stop member secured to said base for terminating the sliding movement of said first end portion of said support arm when said gate is in said preselected vehicle impact position.

9. The vehicle security barrier of claim 8 wherein said base comprises first and second oppositely disposed sections, said first and second sections each defining an inner edge, and wherein said inner edge of said first section releasably engages said inner edge of said second section.

10. The vehicle security barrier of claim 9 wherein said first and second sections of said base each define a panel opening and are each provided with travelway panels for being releasably received in said panel openings.

11. The vehicle security barrier of claim 8 wherein said security barrier further comprises anti-skid means for facilitating the stationary positioning of said base upon said roadway.

12. The vehicle security barrier of claim 8 wherein said security barrier further comprises anti-backup means for prohibiting said vehicle from exiting said travelway via said entryway.

13. The vehicle security barrier of claim 12 wherein said anti-backup means comprises a tire puncture device mounted on said base proximate said forward end portion of said base.

14. A vehicle security barrier for selectively prohibiting a vehicle from accessing a preselected area and for otherwise controlling vehicular traffic on a roadway, said vehicle security barrier comprising:

a base defining a travelway over which said vehicle can be driven, said base comprising first and second side barriers oppositely disposed on either side of said travelway for preventing said vehicle from exiting said travelway, said base further comprising a forward end portion defining an entryway whereby said vehicle enters onto said travelway and a rearward end portion defining a travelway exit whereby said vehicle selectively exits said travelway, said first and second side barriers defining first and second cylinder housings and first and second gate housings;

a security gate pivotally mounted on said base proximate said rearward end portion of said base for being selectively raised to obstruct said travelway, said gate defining first and second opposite end portions and an outboard edge portion, said first end portion of said gate being received in said first gate housing and said second end portion of said gate being received in said second gate housing, said gate being pivotable from a position overlying said travelway whereby said gate is traversable by said vehicle, to a normally raised position wherein said gate obstructs said vehicles exit via said travelway exit, to a full impact position;

reciprocal actuating means for selectively raising and lowering said security gate, said actuating means comprising a first fluid actuated cylinder secured to said base and housed within said first cylinder housing, said first cylinder comprising a selectively reciprocating actuator arm for engaging said gate, said actuating means further comprising a second fluid actuated cylinder secured to said base and housed within said second cylinder housing, said second cylinder comprising a selectively reciprocating actuator arm for engaging said gate proximate said second end portion of said gate; and gate support means for bracing said gate upon said gate pivoting to said preselected vehicle impact position, said gate support means comprising a support arm having a first end portion pivotally and slidably secured to said base and a second end portion pivotally secured to said gate proximate said outboard edge of said gate, said gate support member further comprising a stop member secured to said base for terminating the sliding movement of said first end portion of said support arm when said gate is in said preselected vehicle impact position.

15. The vehicle security barrier of claim 14 wherein said base comprises first and second oppositely disposed sections, said first and second sections each defining an inner edge and wherein said inner edge of said first section releasably engages said inner edge of said second section.

16. The vehicle security barrier of claim 15 wherein said first and second sections of said base each define a panel opening, and are each provided with travelway panels for being releasably received in said panel openings.

17. The vehicle security barrier of claim 16 wherein said security barrier further comprises anti-skid means for facilitating the stationary positioning of said base upon said roadway.

18. The vehicle security barrier of claim 17 wherein said security barrier further comprises anti-backup means for prohibiting said vehicle from exiting said travelway via said entryway.

19. The vehicle security barrier of claim 18 wherein said anti-backup means comprises a tire puncture device mounted on said base proximate said forward end portion of said base.

* * * * *